US006676120B1

(12) United States Patent
Hallbeck et al.

(10) Patent No.: US 6,676,120 B1
(45) Date of Patent: Jan. 13, 2004

(54) BAR CLAMP HAVING ERGONOMIC HANDLE

(75) Inventors: M. Susan Hallbeck, 2701 Stratford Ave., Lincoln, NE (US) 68502; Myung-Chul Jung, 311 Toftrees Ave., #239, State College, PA (US) 16803

(73) Assignees: M. Susan Hallbeck, Lincoln, NE (US); Myung-Chul Jung, State College, PA (US)

( * ) Notice: Subject to any disclaimer, the term of this patent is extended or adjusted under 35 U.S.C. 154(b) by 0 days.

(21) Appl. No.: 09/697,550

(22) Filed: Oct. 26, 2000

(51) Int. Cl.[7] ..... B25B 5/02
(52) U.S. Cl. ..... 269/6
(58) Field of Search ..... 269/3, 6, 166–170; 81/487, 427, 5; 29/268

(56) References Cited

U.S. PATENT DOCUMENTS 4,893,801 A * 1/1990 Flinn ..... 269/6
4,926,722 A 5/1990 Sorensen et al.
4,965,958 A * 10/1990 Cedergreen et al. ..... 81/427.5
5,009,134 A 4/1991 Sorensen et al.
D320,919 S 10/1991 Sorensen
5,094,131 A 3/1992 Sorensen et al.
5,255,422 A * 10/1993 Russo et al. ..... 29/268
5,279,140 A * 1/1994 Blake et al. ..... 81/427.5
5,873,568 A * 2/1999 Mayfield ..... 269/3
6,202,518 B1 * 3/2001 Moffitt et al. ..... 81/427.5

* cited by examiner

*Primary Examiner*—Robert C. Watson
(74) *Attorney, Agent, or Firm*—Shook, Hardy & Bacon LLP

(57) ABSTRACT

The present invention generally relates to a handle assembly for a hand operable bar clamp having a fixed jaw, a movable jaw and a drive for translating the movable jaw towards the fixed jaw. The assembly includes a handgrip and a trigger handle. The handgrip having an elongated rear portion has a generally rounded surface and being contoured to complement the natural transverse curve of a human palm. The trigger handle is pivotal with respect to the handgrip. The trigger handle includes an elongated front portion having a rounded front surface and being contoured to complement the natural palmar curve of a set of fingers flexed toward the palm. The shape and contour of the handle assembly cause pressure to be safely distributed across the user's hand when the handgrip and the trigger handle are grasped and the trigger handle is depressed toward said handgrip.

7 Claims, 2 Drawing Sheets

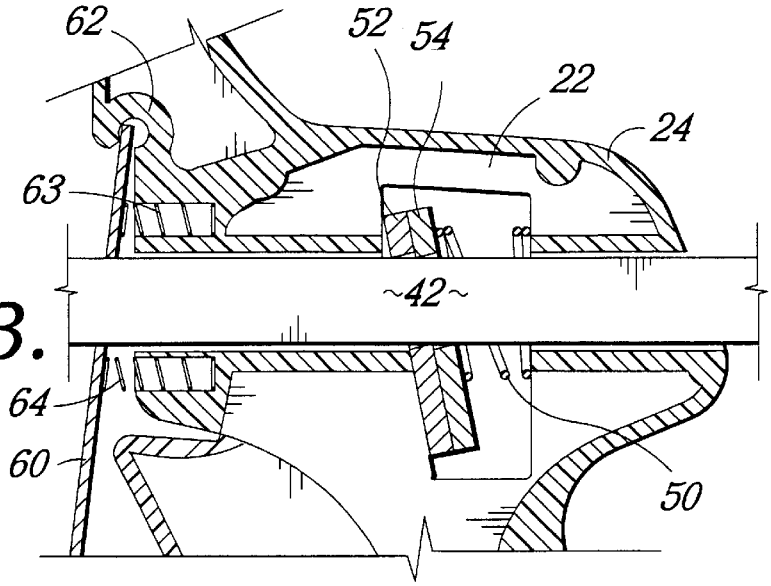
FIG. 3.
FIG. 4.
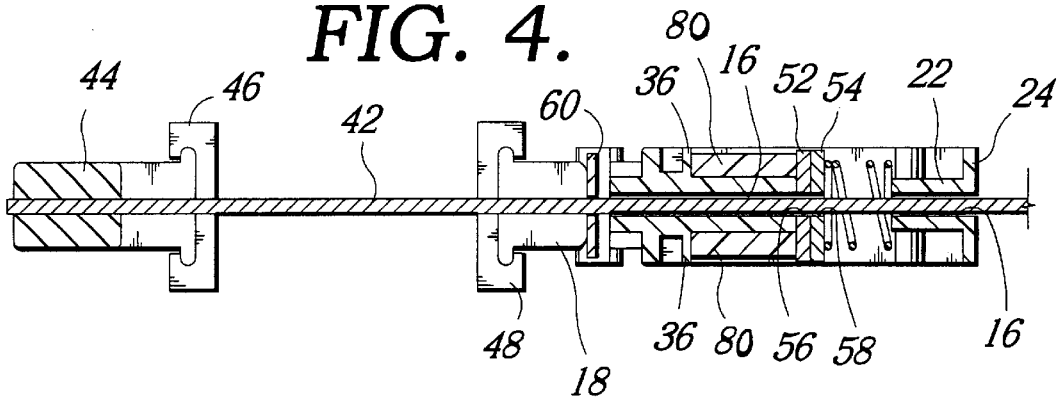
FIG. 5.
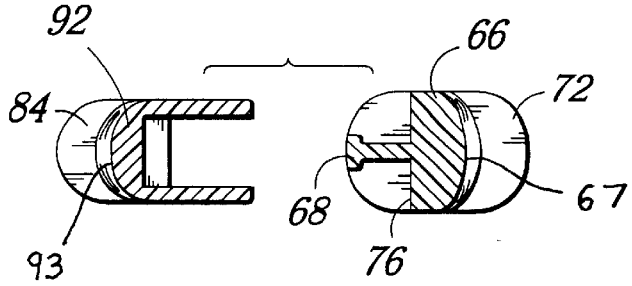

BAR CLAMP HAVING ERGONOMIC HANDLE

CROSS-REFERENCE TO RELATED APPLICATION

Not applicable.

STATEMENT REGARDING FEDERALLY SPONSORED RESEARCH OR DEVELOPMENT

Not applicable.

BACKGROUND OF THE INVENTION

This invention relates to a hand tool and more particularly to a bar clamp having an ergonomic handle.

Hand tools are used to perform a number of tasks. One type of hand tool is a bar clamp typically used to hold two articles together while the articles are secured to one another such as by adhering or welding.

In particular, in a QUICK-GRIP bar clamp sold by AMERICAN TOOL COMPANY and disclosed in U.S. Pat. No. 5,009,134 to Joseph A. Sorensen and Dwight L. Gatzemeyer, a bar clamp has a fixed jaw coupled with a handle/grip assembly. A slide bar is received within and is movable relative to the handle/grip assembly. A movable jaw is secured to the free end of the slide bar and is oriented to face the fixed jaw. The handle/grip assembly includes a handgrip and a trigger handle that pivots with respect to the handgrip. As the U-shaped trigger handle is depressed, the trigger handle moves towards and receives a portion of the handgrip. Simultaneously, a driving lever located within a recess defined by the handle/grip assembly is contacted by the trigger handle so that the driving lever frictionally engages the slide bar and pulls the bar so that the movable jaw is translated toward the fixed jaw. The slide bar is moved incrementally each time the trigger handle is depressed until the articles are clamped between the jaws. A spring biased braking lever prevents movement in the opposite direction when the driving lever is not engaging the slide bar such as, for instance, when the trigger handle is retracted from the handgrip. To unclamp the articles, the braking lever is depressed to allow movement of the slide bar in the opposite direction.

However, the QUICK-CLAMP bar clamp suffers from a number of significant drawbacks. For instance, the contour and profile of the trigger handle causes harmful pressure concentrations on the fingers. Specifically, protrusion on the handgrip oftentimes causes concentrations of pressure at the thumb crotch and thenar eminence of the user's hand.

Other problems result from using the QUICK-CLAMP bar clamp. For instance, the relationship of the trigger handle to the hand grip creates dangerous pressure points at the distal and terminal ends of the handle. Moreover, the effective length and the width of handle assembly of the QUICK-CLAMP bar clamp make the clamp unsuitable for many users. For example, the width of the handle at the flared distal ends of the trigger handle and handgrip is more than ten centimeters. This width is too great to allow the user's fourth digit (or ring finger) and fifth digit (or little finger) to grasp the bar clamp when the clamp is used in an upright, gun-like posture. Similarly, when used in an inverted manner, the second digit (or index finger) and third digit (or middle finger) of many users are incapable of grasping the end of the handle. With respect to the length of the handle, while the handle length of the handgrip of the QUICK-CLAMP bar clamp exceeds ten centimeters, the flared shape of the handle diminishes the effective graspable length of the handle by more than two centimeters. This effective length is unacceptable for many larger males, particularly those in the top five percentile for hand size and those operating the bar clamp with gloves on their hands.

In a different vein, the QUICKCLAMP bar clamp also suffers from excessive handle travel. When the trigger handle is depressed, the handle moves for some distance before the driving levers engage the slide bar. This wasted movement requires additional repetitions to translate the slide bar the desired distance and leads to significant hand and forearm fatigue. The cumulative effect of the shortcomings of such prior art bar clamps may lead to temporary discomfort, long lasting pain and even debilitating injuries such as upper extremity trauma.

BRIEF SUMMARY OF THE INVENTION

The present invention generally relates to a handle assembly for a hand operable bar clamp having a fixed jaw, a movable jaw and a drive for translating the movable jaw towards the fixed jaw. The assembly includes a handgrip and a trigger handle. The handgrip having an elongated rear portion has a generally rounded surface and being contoured to complement the natural transverse curve of a human palm. The trigger handle is pivotal with respect to the handgrip. The trigger handle includes an elongated front portion having a rounded front surface and being contoured to complement the natural palmar curve of a set of fingers flexed toward the palm. The shape and contour of the handle assembly cause pressure to be safely distributed across the user's hand when the handgrip and the trigger handle are grasped and the trigger handle is depressed toward said handgrip.

By providing a hand clamp in accordance with the present invention, numerous advantages are achieved. The shape of the handle maximizes the area of contact between the user's hand and the grip to more evenly distribute the load of the force across the user's hand. The long rounded handgrip and trigger handle allow hands of almost all sizes to comfortably wrap around the handle assembly. As a result, less gripping force is required to use the handle of the present invention, and the amount of hand and forearm fatigue associated with extended use of the tool is diminished. The handle is more comfortable when holding and squeezing the handle assembly in both the pistol and inverted orientations. Moreover, the minimum gripping force is increased and the maximum gripping force is decreased to result in a smaller force variation for more comfortable operation of the tool. The bar clamp of the present invention also reduces the amount of handle travel so that the number of repetitions required to move the jaws is reduced. Moreover, the bar clamp of the present invention does not have any of the dangerous pinch points plaguing existing bar clamps.

BRIEF DESCRIPTION OF THE SEVERAL VIEWS OF THE DRAWING

FIG. 3 is an enlarged fragmentary sectional view of the area identified by line 3 in FIG.

FIG. 4 is a sectional view of the bar clamp taken along line 4—4 in FIG. 1; and FIG. 5 is a sectional view of the handle assembly of the bar clamp taken along line 5—5 in FIG. 1.

DETAILED DESCRIPTION OF THE PREFERRED EMBODIMENTS

Figure 1:
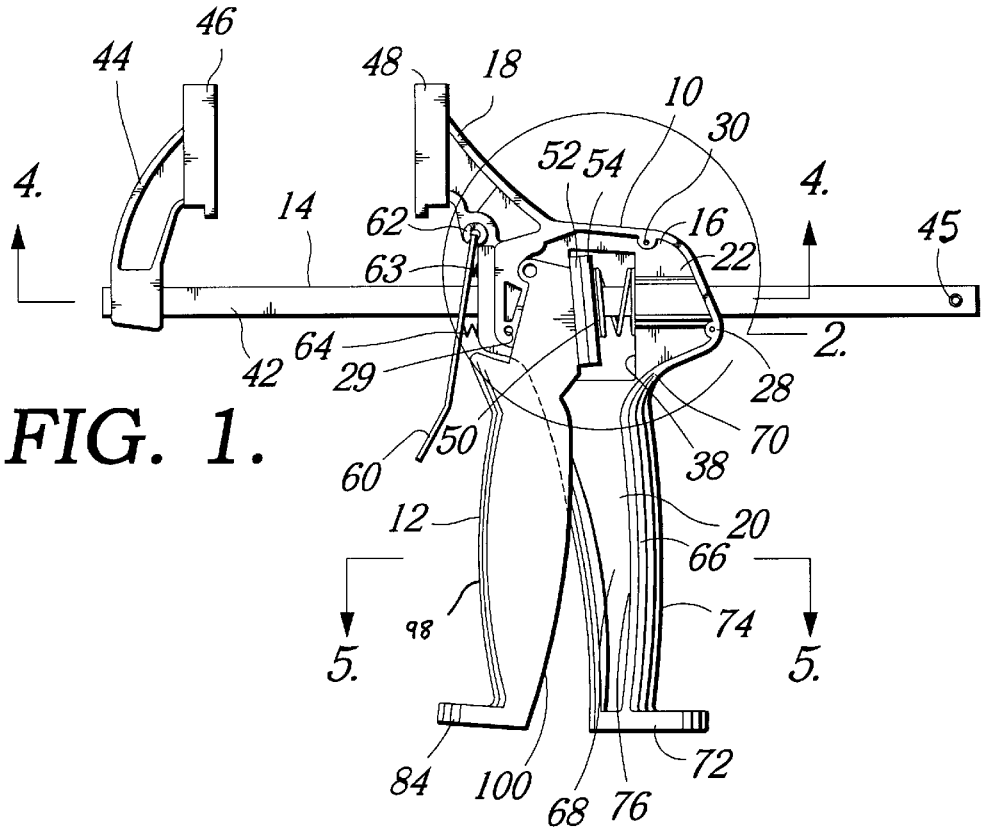
FIG. 1 is a side elevational view of the bar clamp according to the present invention with the protective cover removed to better illustrate the working components of the invention.

A bar clamp constructed in accordance with the present invention is illustrated in FIG. 1, and broadly includes a body 10, a trigger handle 12 and a slide bar assembly 14.

Figure 2:
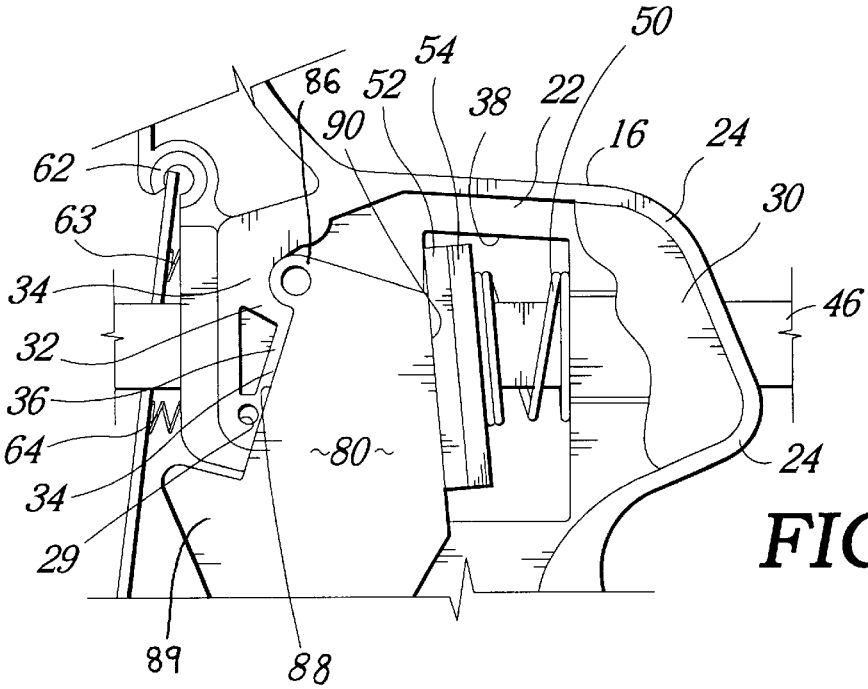
FIG. 2 is a enlarged, side elevational view of the area encompassed by the circle designated by the number 2 in FIG. 1.

The body 10 includes a base portion 16, a fixed jaw 18 and a handgrip 20. With reference to FIGS. 1 and 3, the base portion includes a plate 22 and a flange 24 extending normally from the opposing faces of the plate so that the plate is recessed with respect to the edges of the flange. The flange 24 encompasses the front and rear edges of the base portion as well as the top edge. Around the perimeter of the flange, a set of threaded apertures 28–30 are located. With particular reference to FIG. 2, a protective cover 30 may be placed over the main body by placing screws (not shown) through apertures in the cover and threading the screws within corresponding apertures 28–30 in the flange.

At the front edge of base portion 16, a trigger handle stop 32 extends inwardly from flange 24. Trigger handle stop 32 includes a pivot seat 34 and a stop plate 36. The pivot seat presents a generally semicircular face within which the trigger handle 12 may rotate as described in greater detail below. The stop plate 36 is oriented to slope toward the front of the base portion 16 as the plate extends from the pivot seat 34.

At the center of base portion 16, a rectangular opening 38 is formed through the plate 22. With reference to FIGS. 2 and 3, a slot 40 is defined between the front and rear edges of the base portion 16 on either side of opening 38. The slide bar assembly 14 engages the body 10 at slot 40. The slide bar assembly is of conventional construction and includes a metal slide bar 42 and a movable jaw 44. The movable jaw 44 is located at one end of the slide bar 42 and has a synthetic contact pad 46 positioned on its face. The slide bar is received within and extended through slot 40, and a small pin 45 is placed on the end of the bar to prevent the slide bar assembly from disengaging the body 10.

The fixed jaw 18 extends from the front and top edges of flange 24 of base portion 16. The face of the fixed jaw is directed toward the face of the movable jaw 44 and is similarly covered by a synthetic contact pad 48. A spring 50 is placed about the portion of the slide bar 42 located within the opening 38. As shown in FIG. 4, a pair of driving levers 52 and 54 are placed around the spring bar 16 at slots 56 and 58 located within each of the respective levers. The spring biases the driving lever 54 in the direction of the trigger handle 12.

On the exterior of the body 10, a conventional braking lever 60 is placed around the slide bar 42. The braking lever 60 pivots about a seat 62 located on the underside of fixed jaw 18. The braking lever 60 is spring biased away from base portion 16 by a pair of small compression springs 63 and 64 extending normally from the front of the base portion 16. The opening (not shown) through which the slide bar extends is sized so that the braking lever engages the slide bar 42 to prevent translation of the movable jaw away from the body when the braking lever is not being depressed by the user.

The handgrip 20 of the present invention extends downwardly from the base portion 16 of body 10. With reference to FIGS. 1 and 5, the handgrip 20 includes a rear portion 66 and a forwardly directed member 68. At the proximal end of the handgrip 20, the rear surface 66 transitions into the flange 24 of the base portion 16 to define a wide radius chamfer portion 70. At the distal end of the handgrip 20, a kerf 72 projects rearwardly from the handgrip 20. The effective length of the handgrip extends almost completely from the base portion 16 to the kerf 72. The preferred ergonomic length sufficient for hand sizes up to and exceeding the 95th percentile male is about 130 to 135 millimeters.

Looking more closely at the rear portion 66, the rear portion has a generally rounded rear surface 67 (FIG. 1 and 5) and has a contour shaped to complement the palmar curve of a human's hand as best exemplified by the side profile edge 74 (FIG. 1). The palmar curve is typified by a smooth curve that is slightly convex with respect to the long axis of the handgrip 20. The flat inner surface 76 opposes the rounded rear surface 67 of the rear portion 66. The width of the material between the rounded rear surface 67 and the flat surface 76 prevents the user from pinching his or her palm between the flat surface 76 and trigger handle 12 when the trigger handle is depressed as described below.

The trigger handle 12 has an upper portion 80, a handle portion 82 and a kerf 84. The upper portion 80 is forked and fits on either side of the plate 22 proximate trigger handle stop 32 (FIGS. 2 and 4). Each side of the upper portion 80 includes a pivot point protrusion 86 and a back face 88 corresponding to the stop plate 36 of the trigger handle stop 32. On the side of the upper portion 80 opposite the stop plate 36, a drive plate 90 is located. With reference to FIG. 2, the drive plate is angled rearwardly with respect to the slide bar 42. As best shown in FIG. 3, the angle of the drive plate 80 with respect to the side bar 42 is such that the drawing levers 52 and 54 are nearly engaged with the slide bar 46 when the back face 88 is held against the stop plate 36 by the force of spring 50. The typical angle of the drive plate 90 with respect to the slide bar 42 is about 5–10° in the undepressed portion, and the angle between the back face 88 and the drive plate 90 is preferably about 20°.

On the end of the back face 88 opposite the pivot point, the trigger handle has a second protrusion 89 extending along the underside of the base portion as the base portion approaches the braking lever 60. The triangular shaped protrusion 89 tapers toward the front of the handle portion 80. This protrusion prevents the user's from pinching his or her fingers between the trigger handle and braking lever during operation.

The handle portion 82 of the trigger handle 12 extends from the upper portion in a generally normal orientation with respect to the slide bar 46. With reference to FIGS. 1 and 5, the handle portion 82 has a front portion 92 and a pair of generally planar members 94 and 96 extending from the rounded portion 92 in parallel relationship to one another to define a hollow between the members and the front portion. The effective length of the trigger handle is only slightly less than the handgrip.

Looking more closely at front portion 92, the front portion has a generally rounded front surface 93 (FIG. 5) and is contoured to complement the natural palmar curve of a set of fingers flexed toward the palm of the hand as exemplified by side profile edge 98. The curvature is relatively similar to the curvature of the transverse palmar curve of the handgrip and is typified by a slightly convex curve with respect to the long axis of the trigger handle. The similarity is important for obtaining ergonomic advantages when the hand clamp is used in the inverted position so that the palm is placed on the trigger handle and the fingers are extended around the hand grip.

In the static, undepressed position, the front surface 93 of the trigger handle is at a distance of between 50 to 60 millimeters from the rear surface 67 of the handgrip. Accordingly, hand sizes larger than the 5th percentile female can safety grip the handle assembly with digits 3 and 4 as is ergonomically advantageous.

Preferably, the main body 10 and trigger handle 14 are made from a synthetic material such as 30% glass fiber reinforced nylon. However, the components may be preferably formed from other slightly compressible materials such as other lightweight plastics and various types of wood to achieve the ergonomic benefits. Also, some surface texture may be applied to aid the user in gripping the handle assembly of the trigger handle and handgrip.

The operation of the bar clamp is generally similar to that of prior bar clamps. Namely, the user places his or her hand around the handgrip 20 and handle portion 82 of trigger grip handle 12. As the user squeezes the trigger handle 12 toward handgrip 20, the I-member 68 of the handgrip is received within the hollow space defined by the planar members 94 and 96. During the stroke, the drive plate 90 pivots the driving levers 52 and 54 about their upper end so that the driving levers almost inunediately engage the slide bar and pull the bar rearwardly. Once the trigger handle has been depressed and is released, the spring 50 biases the trigger handle 14 away from the handgrip 20. As the driving levers 52 and 54 are pivoting rearwardly, the levers disengage the slide bar. During this process, the braking lever 60 prevents the slide bar 42 from moving in the opposite direction. With each successive stroke, the contact 46 on the end of movable jaw 44 moves in the direction of the opposing contact 48 on the end of the fixed jaw 18.

By placing the driver levers in contact with the slide bar 42 and the trigger handle 14 in the undepressed position, the handle travel associated with the previous bar clamps is eliminated. Elimination of this hand travel decreases the number of repetitions required to move the jaw 44 to the required distance from the fixed jaw 18. Those injuries attributable to repetitive stress are likewise diminished.

The curvature and contour of the trigger handle and handgrip cause the pressure to be distributed across the user's hand instead of the concentrations of pressure associated with the previous solutions. The pressure developed during operation is distributed more equally across the user's fingers while allowing digits 3 and 4 to flex and pull the trigger handle. On the opposing side, the force is directed to the palm at palm 2—the area having sufficient fatty tissue and muscle to sustain the load—that is located at a distance from the less protected palm 1 area proximate the thumb crotch.

The combination of the contour and shape of the handgrip and trigger handle allow the effective length of the handgrip to equal the total length as opposed to previous handgrips that are typified by sharp protrusions and bends that diminish the effective length. Moreover, the effective length does not change depending on whether the bar clamp is used in the pistol position, inverted position, or any position therebetween.

Also, the shape and size of the handgrip and trigger lever, as well as the orientation of the relationship between one another and the remainder of the bar clamp, avoids the presence of potentially dangerous pinch points. Namely, it is difficult if not impossible for a user to pinch his or her hand with between the distal end of the trigger handle and the body or braking lever of the clamp. Likewise, it is difficult to pinch a portion of the user's palm between the handgrip and the trigger handle.

From the foregoing, it will be seen that this invention is one well-adapted to obtain all the needs and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed is:

1. A handle assembly for a hand operable bar clamp having a fixed jaw, a movable jaw and a drive for translating the movable jaw towards the fixed jaw, said handle assembly comprising:

a handgrip with an elongated rear portion, said rear portion having a generally rounded rear surface and being contoured to complement the natural transverse planar curve of the palm, and said rear portion being convex relative to a long axis of the handgrip; and a trigger handle pivotal with respect to said handgrip, said trigger handle includes a front portion, said front portion having a rounded front surface and being contoured to complement the natural palmar curve of a set of fingers flexed toward the palm, and said trigger handle being convex relative to a long axis of the trigger handle so that pressure is safely distributed across the user's hand when said handgrip and said trigger handle are grasped and said trigger handle is depressed toward said handgrip and wherein said trigger handle has a terminal end and wherein said trigger handle further comprises a planar kerf at said terminal end, wherein said kerf extends forwardly from said front portion of said trigger handle.

2. A handle assembly as recited in claim 1, wherein said handgrip has a terminal end and wherein said handgrip further comprises a planar kerf at said terminal end, wherein said kerf extends rearwardly from said rear portion of said handgrip.

3. A handle assembly as recited in claim 1, wherein said rear portion of said handgrip has a flat surface opposite said rounded rear surface and an I-member extending from said flat surface.

4. A handle assembly as recited in claim 3, wherein said handgrip further comprises a pair of opposing side walls extending from said front portion, said side walls defining a cavity wherein said I-member of said handgrip is received when said trigger handle is pivoted toward said handgrip.

5. A handle assembly as for a hand operable bar clamp having a fixed jaw, a movable jaw and a drive for translating the movable jaw towards the fixed jaw, said handle assembly comprising:

a handgrip with an elongated rear portion, said rear portion having a generally rounded rear surface and being contoured to complement the natural transverse planar curve of the palm, and said rear portion being convex relative to a long axis of the handgrip;

a trigger handle pivotal with respect to said handgrip, said trigger handle includes a front portion, said front portion having a rounded front surface and being contoured to complement the natural palmar curve of a set of fingers flexed toward the palm, and said trigger handle being convex relative to a long axis of the trigger handle so that pressure is safely distributed across the user's hand when said handgrip and said trigger handle are grasped and said trigger handle is depressed toward said handgrip; and a breaking lever coupled with the fixed jaw, wherein said trigger handle has an initial end, and wherein said trigger handle has a protrusion extending from said front portion proximate said initial end to a position proximate to the breaking lever.

6. A handle assembly for a hand operable bar clamp having a fixed jaw, a movable jaw and a drive for translating the movable jaw towards the fixed jaw, said handle assembly comprising:

a handgrip with an elongated rear portion, said rear portion having a generally rounded rear surface and being contoured to complement the natural transverse planar curve of the palm, and said rear portion having a flat surface opposite said rounded rear surface and an I-member extending from said flat surface; and a trigger handle pivotal with respect to said handgrip, said trigger handle includes a front portion, said front portion having a rounded front surface and being contoured to complement the natural palmar curve of a set of fingers flexed toward the palm so that pressure is safely distributed across the user's hand when said handgrip and said trigger handle are grasped and said trigger handle is depressed toward said handgrip.

7. A handle assembly as recited in claim 6, wherein said handgrip further comprises a pair of opposing side walls extending from said front portion, said side walls defining a cavity wherein said I-member of said handgrip is received when said trigger handle is pivoted toward said handgrip.

* * * * *